United States Patent [19]

Kushnir

[11] Patent Number: 4,862,695

[45] Date of Patent: Sep. 5, 1989

[54] SPLIT STERLING CRYOGENIC COOLER

[75] Inventor: Mark Kushnir, Rehovot, Israel

[73] Assignee: ICE Cryogenic Engineering Ltd., Tel Aviv, Israel

[21] Appl. No.: 116,469

[22] Filed: Nov. 3, 1987

[30] Foreign Application Priority Data

Nov. 5, 1986 [IL] Israel ..... 80516
May 1, 1987 [IL] Israel ..... 82403

[51] Int. Cl.[4] ..... F25B 9/00
[52] U.S. Cl. ..... 62/6; 60/520
[58] Field of Search ..... 62/6; 60/520

[56] References Cited

U.S. PATENT DOCUMENTS

| | | | |
|---|---|---|---|
| 1,546,397 | 7/1925 | Michelsen | 82/47 |
| 1,670,799 | 5/1928 | Dornbirer | 417/439 |
| 1,787,700 | 1/1931 | Persons | 417/439 |
| 1,923,519 | 8/1933 | Tisserant | 417/439 |
| 2,856,857 | 10/1958 | Saalfrank | 103/44 |
| 3,109,293 | 11/1963 | Williams | 62/55 |
| 3,299,828 | 1/1967 | Josephian | 103/153 |
| 3,423,948 | 1/1969 | Cowans | 62/6 |
| 3,853,437 | 12/1974 | Horn et al. | 62/6 |
| 3,877,239 | 4/1975 | Leo | 62/6 |
| 3,889,119 | 6/1975 | Whicker et al. | 250/352 |
| 3,906,739 | 9/1975 | Raimondi | 62/6 |
| 3,913,339 | 10/1975 | Berry | 62/6 |
| 4,092,829 | 6/1978 | Durenec | 62/6 |
| 4,156,584 | 5/1979 | Schuck | 417/435 |
| 4,277,948 | 7/1981 | Horn et al. | 62/6 |
| 4,306,419 | 12/1981 | Schwartz | 62/6 |
| 4,339,927 | 7/1982 | Sarcia | 62/6 |
| 4,388,808 | 6/1983 | Durenec | 62/6 |
| 4,394,819 | 1/1983 | Averill | 62/514 R |
| 4,403,478 | 9/1983 | Robbins | 62/6 |
| 4,409,793 | 10/1983 | Durenec | 62/6 |
| 4,412,423 | 11/1983 | Durenec | 62/6 |
| 4,430,863 | 2/1984 | Longsworth | 62/6 |
| 4,481,777 | 10/1984 | Sarcia | 62/6 |
| 4,501,120 | 2/1985 | Holland | 62/6 |
| 4,514,987 | 5/1985 | Pundak et al. | 62/6 |
| 4,520,629 | 6/1985 | Dix et al. | 62/6 |
| 4,532,766 | 8/1985 | White | 62/6 |
| 4,539,818 | 9/1985 | Holland | 62/6 |
| 4,550,571 | 11/1985 | Bertsch | 62/6 |
| 4,569,203 | 2/1986 | Rawlings et al. | 62/6 |
| 4,619,112 | 10/1986 | Colgate | 62/6 |
| 4,620,418 | 11/1986 | Fujiwara et al. | 62/6 |
| 4,627,795 | 12/1986 | Montz | 417/267 |
| 4,642,995 | 2/1987 | Bachler et al. | 62/6 |
| 4,713,939 | 12/1987 | Keith | 62/6 |

FOREIGN PATENT DOCUMENTS

| | | | |
|---|---|---|---|
| 63642 | 8/1981 | Israel . | |
| 1146481 | 3/1985 | U.S.S.R. | 417/439 |
| 1235309 | 6/1971 | United Kingdom | 417/439 |

*Primary Examiner*—Ronald C. Capossela
*Attorney, Agent, or Firm*—Amster, Rothstein & Ebenstein

[57] ABSTRACT

A split Stirling cryogenic cooler including a compressor located in a first unit, and, located in a second unit, an expander-displacer defining an expansion volume, a cold tip adjacent the expansion volume, a regenerator heat exchanger and a displacer, a pneumatic conduit coupled the first unit to the second unit whereby pressurized gas pulses are provided from the compressor to the displacer for driving therof in oscillatory motion and apparatus for providing controllable damping of the resonant motion of the displacer comprising pneumatic flow produced friction damping apparatus.

5 Claims, 2 Drawing Sheets

SPLIT STERLING CRYOGENIC COOLER

FIELD OF THE INVENTION

The present invention relates to cryogenic refrigerators generally and more particularly to Stirling cryocoolers of the split type.

BACKGROUND OF THE INVENTION

In recent years thermal imaging technology has developed a capability of providing images of television quality or better for various applications, such as aerial terrain mapping, target determination and acquisition, surveillance, electrical fault location, medical imaging, and irrigation control.

One particularly useful technique for thermal imaging is known as "cool IR". This technique has the advantage of being able to carry out imaging over great distances, in total darkness, on camouflaged objects and through cloud cover. Cool IR systems require an IR detector to be cooled to the temperature of liquid air, about 77 K, for efficient operation.

Various types of cryogenic refrigerators are known for cool IR applications. These include liquid nitrogen cryostats, Joule-Thomson coolers and closed cycle cryocoolers. For certain applications, closed cycle cryocoolers are preferred.

There exist a variety of configurations of closed cycle cryocoolers. These include Stirling, Vuilleumier (VM) and Gifford-McMahon (GM) cryocoolers. A preferred configuration is the integral type.

A basic integral Shirling crycooler comprises a compressor section and an expander-displacer section combined in one integrated package. Reciprocating elments of both the expander-displacer and the compressor are mechanically driven via a common crankshaft. The integral configuration guarantees a prescribed displacer stroke and displacer/compressor phase relationship, but it involves a disadvantage in that the vibration output of the compressor is transmitted to the cooled device due to the close proximity of the components.

A further disadvantage in integral Stirling cryocoolers lies in their compressor seals. Various types of dynamic compressor seals are employed, including clearance seals. These tend to wear overtime, releasing particulate matter into the system; this interferes with the operation of the Stirling regenerator.

Additional contamination of the regenerator is caused by lubrication materials and other materials associated with parts of the drive motor which are generally located in fluid communication with the regenerator.

An integral Stirling cryocooler which overcomes the above-described disadvantages is described in unpublished copending Israel Patent Application No. 78933 filed May 26, 1986.

Split Stirling cryocoolers are also known in the prior art. Split Stirling cryocoolers overcome the problem of transmission of vibrations to the cooled device, encountered in integral cryocoolers. However, in view of the fact that the displacer of a split cryocooler is not mechanically connected to the motor, problems of nonuniformity of displacer motion occur. These problems arise from instability of the pressure of the pulses produced by the compressor due to use of a dynamic seal and instability on the applied damping force.

One example of a split Stirling cryocooler is a cryocooler manufactured by Ricor in Israel having apparatus for producing a magnetic damping force. This apparatus has the disadvantage that electromagnetic fields are generated thereby, causing possible interference with sensitive electrical and electro-optical apparatus in the vicinity thereof and thus requiring extensive shielding. Additionally, the magnetic damping is extremely difficult to fine tune to provide optimized damping. The above Ricoh cryocooler is described in U.S. Pat. No. 4,514,987, which shows the use of a viscous friction damper wherein a narrow circumferential gas flow passage is defined between a piston and a cylinder in which the piston moves.

Another type of split Stirling cryocooler employs a dynamic seal. Cryocoolers of this type are manufactured by Martin Marietta and CTI in the U.S.A. and have the disadvantages described hereinabove in connection with compressor seals.

SUMMARY OF THE INVENTION

The present invention seeks to provide an improved split Stirling cryogenic cooler which overcomes some or all of the above-described disadvantages of conventional split cryocoolers.

There is thus provided in accordance with a preferred embodiment of the present invention a split Stirling cryogenic cooler including a compressor located in a first unit, and, located in a second unit, an expander-displacer defining an expansion volume, a cold tip adjacent the expansion volume, a regenerator heat exchanger and a displacer, a pneumatic conduit coupling the first unit to the second unit whereby pressurized gas pulses are provided from the compressor to the displacer for driving thereof in oscillatory motion and apparatus for providing controllable damping of the resonant motion of the displacer comprising pneumatic flow produced friction damping apparatus.

In accordance with this embodiment of the invention, the pneumatic flow produced friction damping apparatus comprises a damping volume having a uniform cross section along at least a portion thereof defining a piston travel path, and a piston disposed within the damping volume along the piston travel path and coupled to the displacer, either or both of the piston and the piston travel path being configured to permit a piston velocity dependent frictional resistance to the travel of the piston along the piston travel path produced by the flow of gas from one part of the damping volume to another part past the piston.

Additionally in accordance with one embodiment of the present invention, the piston travel path and the piston are dimensioned to define a generally uniform peripheral flow space therebetween. Alternatively, a narrow aperture may be formed through the piston to provide communication from one part of the damping volume to another part. As a further alternative a passageway may be formed communicating with both parts of the damping volume at the walls of the piston travel path.

Further in accordance with a preferred embodiment of the invention, the annular flow space has a radial dimension perpendicular to the travel axis of the piston expressed by $$H = \sqrt{12\mu u L/\Delta P}$$

where u=gas velocity
ΔP=pressure drop
L=length of damping piston
μ=dynamic viscosity Still further in accordance with a preferred embodiment of the present invention, the controllable damping feature is provided by bellows which may be selectably and fixedly oriented to define the desired damping volume. It is appreciated that by expanding the damping volume, the gas pressure therein is decreased, thus decreasing the frictional resistance provided by the damping apparatus.

According to a preferred embodiment of the invention, a low vibration coupling is provided between the first and second units.

Additionally in accordance with an embodiment of the invention, the compressor is driven by electric motor apparatus including a stator located externally of the compressor and expander-displacer portion and not in fluid communication with the interiors thereof.

Additionally in accordance with an embodiment of the present invention, the compressor includes a dynamic seal such as a metal/metal seal formed of stainless steel which may include a labyrinth.

According to a preferred embodiment of the present invention, all of the above features are incorporated into the cyrogenic cooler. According to alternative embodiments of the invention, various combinations of the above features may be incorporated in a cryogenic cooler.

BRIEF DESCRIPTION OF THE DRAWINGS

The present invention will be understood and appreciated more fully from the following detailed description taken in conjunction with the drawings in which.

DETAILED DESCRIPTION OF A PREFERRED EMBODIMENT

Figure 1:
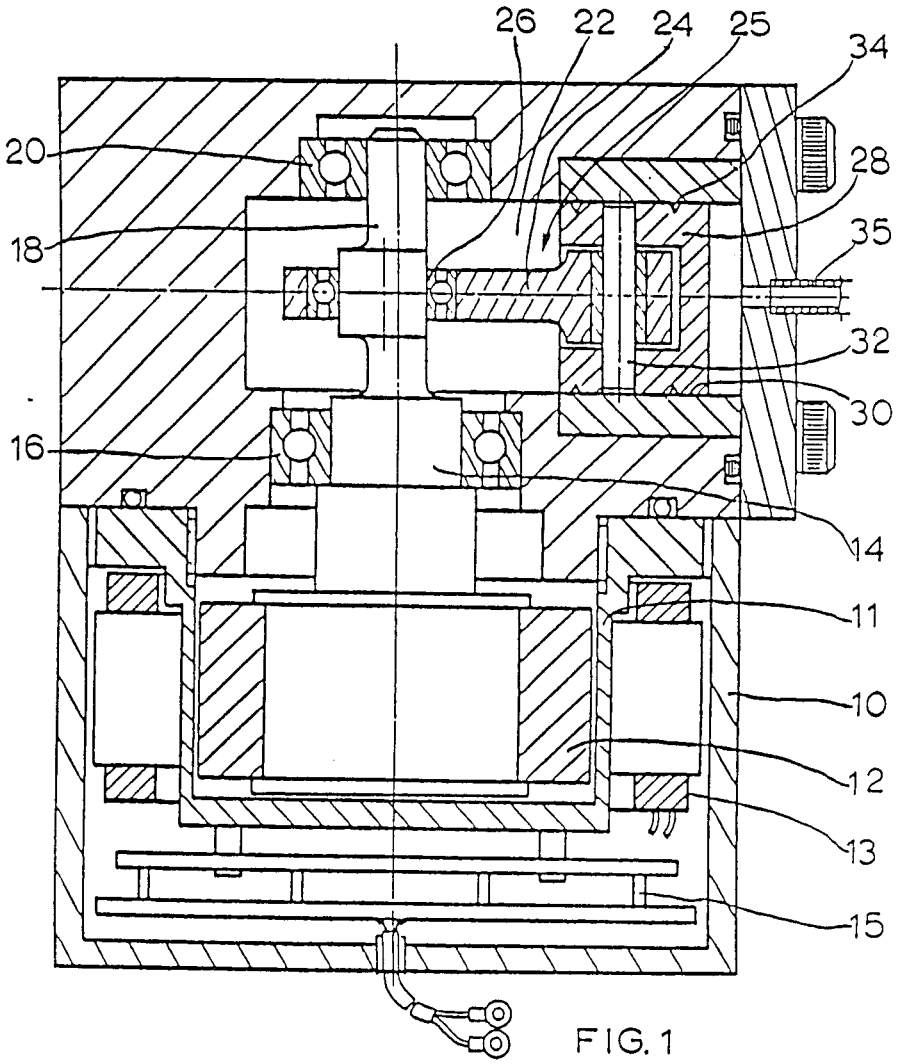
FIGS. 1 and 2 respectively are sectional side view illustrations of first and second subunits of a split Stirling cryogenic cooler constructed and operative in accordance with a preferred embodiment of the present invention.
Figure 2:
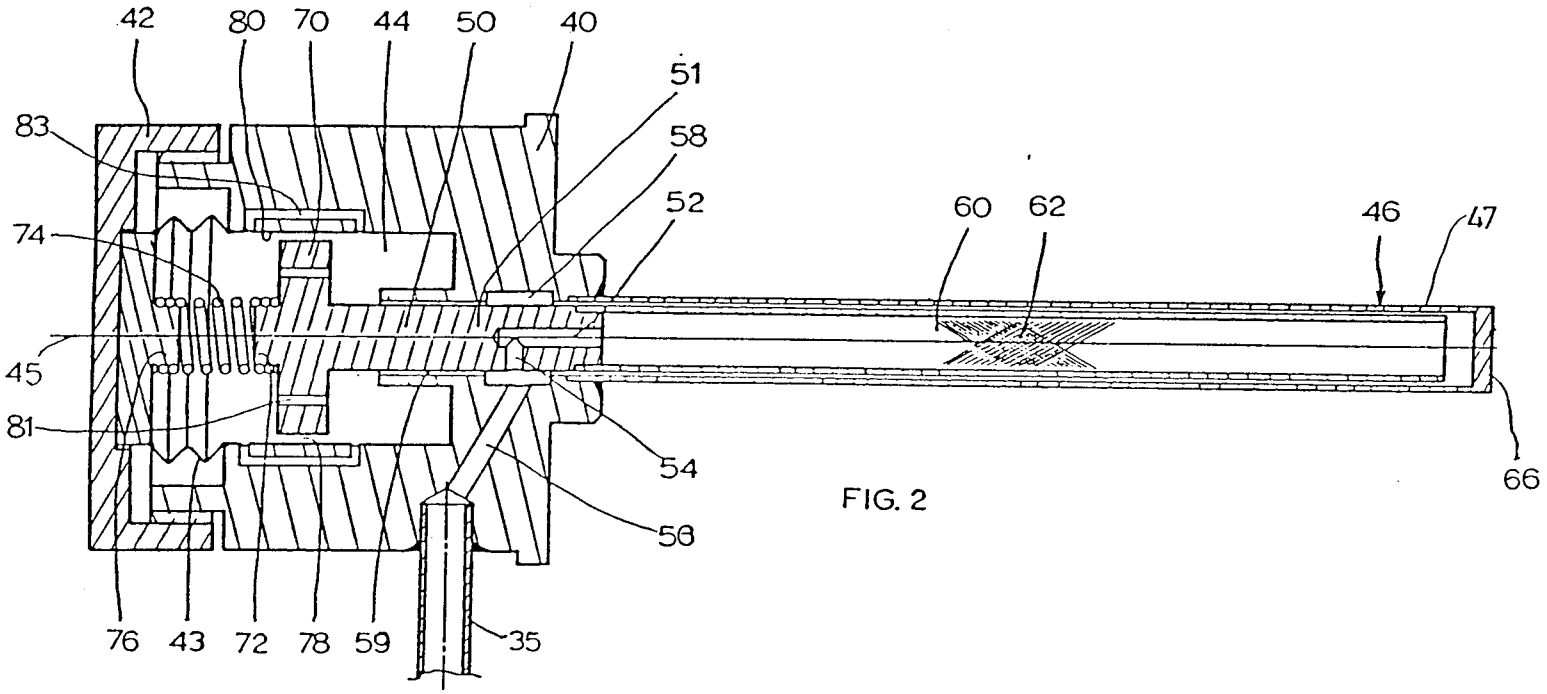

Reference is now made to FIGS. 1 and 2 which together illustrate a cryogenic cooler constructed and operative in accordance with a preferred embodiment of the present invention. The cryogenic cooler comprises first and second units, which are joined by a generally flexible, non vibration transmissive pneumatic conduit, the first unit being illustrated in FIG. 1. The first unit comprises an electric motor housing 10 in which is disposed an electric motor 12. It is a particular feature of the present invention that the rotor 13 and motor control electronics 15 of electric motor 12 are sealed from the interior of the compressor through which refrigerant passes, in order to prevent contamination thereof by particulate matter from the motor 12. This sealing is achieved by means of a partition 11.

A rotational shaft 14 of the electric motor 12 is mounted on a bearing 16 and terminates in a crankshaft 18, which is mounted by means of a bearing 20 in a compressor housing 22, which is fixedly mounted onto electric motor housing 10. A piston rod 24 portion of a drive shaft 25 is mounted onto crankshaft 18 via a bearing 26 and drives a piston 28 in oscillator motion within a piston sleeve 30.

Piston 28 is formed with an internal piston rod mounting element 32 for engagement with the piston rod 24. It is a particular feature of the present invention that a dyanmic seal 34, such as a metal/metal seal typically formed of stainless steel, which may also comprise a labyrinth, is defined between the piston 28 and the sleeve 30 to serve as a dynamic seal. The metal/metal dynamic seal avoids disadvantages of prior art dynamic seals employed in prior art cryogenic coolers, and significantly lowers the amount of particlate material released into the refrigerant by wear of the piston elements. Preferably, a labyrinth is defined in the cylindrical side walls of the piston as shown. A pneumatic conduit 35 couples the interior of piston sleeve 30 to the secónd unit.

As seen particularly in FIG. 2, the second unit comprises a housing 40, which together with a cap member 42 and bellows 43 defines a damping volume 44. Sealingly mounted onto housing 40 and extending axially therefrom along an axis 45 is an expander-displacer unit 46, otherwise referred as a "cold finger".

The expander-displacer unit 46 comprises a relatively thin walled tube 47, typically formed of stainless steel. Disposed in free-floating relationship within tube 47 is a regenerator heat exchanger 60 comprised of several hundred fine-mesh metal screens 62, stacked to form a cylindrical matrix. Alternatively, the regenerator heat exchanger may comprise stacked balls or other suitable bodies.

Screens 62 are particularly susceptible to clogging by spurious particulate matter in the refrigerant, and therefore, the placement of the electric motor outside of communication with the refrigerant and the use of labyrinth seals significantly enhances the operating lifetime of the heat exchanger 60.

According to a preferred embodiment of the invention, a detector, such as an infra-red detector, may be mounted directly on the tip 67 of the cold finger 46. This is made possible by the vibration insulation of the cold finger 46 described hereinabove. The mounting of the infra-red detector directly on the cold finger significantly increases the efficiency of cooling of the detector by eliminating thermal losses which would result from less direct mounting. It thus lowers the power requirements of the cooler.

Fixedly mounted onto regenerator-heat exchanger 60 is a piston 50 including a forward portion 51 which is formed with a central bore 52 and a side going bore 54 communicating therewith so as to provide a pressurized gas flow path between the exterior of the forward portion 51 and the heat exchanger 60. Pressurized gas communication with conduit 35 is provided via a bore 56 formed in housing 40, which communicates with the sleeve 58 surrounding part of the forward portion 51 of the piston.

Sleeve 58 is effectively sealed from damping volume 44 by a dynamic seal 59, such as a metal/metal seal formed of stainless steel. Seal 59 may be a labyrinth seal.

It is known that for efficient operation of a Stirling refrigerator, the motion of the regenerator and the piston fixed thereto must have a constant stroke and must be in a constant out of phase relationship with the arrival of pulses of compressed gas thereat. It has been appreciated that in a free-piston construction, the above constraint can best be fulfilled by providing resonant motion of the piston driven by the pulses of pressurized gas. In the present case, the motion of the piston 50 is produced by the reaction force of the gas pulses at the interior of the cold finger 46. In order to maintain precisely resonant motion, a precisely constant damping force is required.

According to the present invention, and in contrast to the teachings of the prior art, the requisite damping force is provided by pneumatic flow produced friction damping, otherwise known as viscous damping. Various structures by means of which this viscous damping may be realized will now be described.

Piston 50 includes a broadened cylindrical portion 70, typically of uniform circular cross section, adjacent to which is disposed a spring seat 72. A compression spring 74 is disposed under compression between spring seat 72 and a spring seat 76 formed onto cap member 42. Spring 74 acts to provide a displacement responsive restoring force to piston 50.

The interior of damping volume 44 in the region of cylindrical portion 70 is typically also formed to have a uniform circular cylindrical cross section, which is selected to provide a precisely defined annular clearance 78 between the outer cylindrical surface of portion 70 and the inner cylindrical surface 80 of the damping volume.

Flow of gas through this narrow clearance produces frictional resistance to the relative movement of the piston 50 with respect to the housing 40 and thus provides the required precisely controllable damping force. A flow of gas is produced when the piston moves along axis 45, due to the change of relative volumes of gas on the two sides of the cylindrical portion 70, producing a differential gas pressure therebetween and consequent gas flow through clearance 78.

The radial thickness of the annular clearance 78 may be expressed as follows:

$$H = \sqrt{12\mu uL/\Delta P}$$

where u=gas velocity

ΔP=pressure drop

L=length of damping piston $\mu$=dynamic viscosity

In accordance with an alternative embodiment of the invention, pneumatic flow passageways may be provided extending through piston 50, as illustrated at reference 81 or through housing 40, as illustrated at reference 83. Either or both of passageways 81 and 83 may be provided in place of or in addition to annular clearance 78. Where annular clearance 78 is eliminated, a clearance seal, such as a metal/metal seal is provided between p8iston 50 and housing 40.

In accordance with a preferred embodiment of the present invention, the amount of viscous damping force provided by the apparatus of the present invention may be precisely adjusted or controlled by selecting the position of cap member 42 relative to housing 40, so as to orient bellows 43 accordingly and thus define a desired volume for damping volume 44. In this way, the operation of the apparatus of the invention may be empirically set for optimized performance. It is appreciated that by expanding the damping volume, the gas pressure therein is decreased, thus decreasing the frictional resistance provided by the damping apparatus.

It will be appreciated by persons skilled in the art that the present invention is not limited by what has been particularly shown and described hereinabove. Rather the scope of the present invention is defined only by the claims which follow:

I claim:

1. A split Sterling engine comprising:

a first unit including a compressor;

a second unit including an expansion volume, a cold tip adjacent the expansion volume, a regenerator heat exchanger and a piston; and a pneumatic conduit coupling the first unit to the second unit whereby pressurized gas pulses are provided from the compressor to the piston for imparting oscillatory motion to the piston, said second unit further including controllable means for damping the motion of the piston including, means defining a selectable damping volume, said piston including a cylindrical portion disposed within said damping volume defining first and second parts of said damping volume on opposite sides of the cylindrical portion thereof and, at least one narrow passageway defined between first and second parts of said damping volume for providing piston velocity dependent frictional resistance to the travel of the piston.

2. Apparatus according to claim 1 and wherein said means defining a selectable damping volume comprises bellows.

3. Apparatus according to claim 1 wherein said pneumatic circuit is constructed to provide a low vibration coupling between said first and second units.

4. Apparatus according to claim 1 wherein said compressor is driven by electric motor means including a stator located externally of the compressor and expander-displacer portion and not in fluid communication with the interiors thereof.

5. Apparatus according to claim 1 wherein said compressor comprises a dynamic metal/metal clearance seal.

* * * * *